United States Patent [19]

Channel

[11] 4,221,368

[45] Sep. 9, 1980

[54] ROTATABLE, TILTABLE AND EXPANDABLE UPHOLSTERY WORK TABLE

[76] Inventor: Chelsey B. Channel, 1506 Ellis Ave., Milpitas, Calif. 95035

[21] Appl. No.: 929,842

[22] Filed: Jul. 31, 1978

[51] Int. Cl.[3] ..... B25B 1/22

[52] U.S. Cl. ..... 269/54.3; 269/71; 269/227

[58] Field of Search ..... 269/71, 75, 139, 227, 269/53, 54–54.5, 77, 80, 82; 144/288 R

[56] References Cited

U.S. PATENT DOCUMENTS

| | | | |
|---|---|---|---|
| 1,373,473 | 4/1921 | Weydell | 144/288 R |
| 1,474,212 | 11/1923 | Statham | 269/71 X |
| 1,603,307 | 10/1926 | Anderson | 269/71 X |
| 2,090,234 | 8/1937 | Robinowitz | 269/54.3 |
| 2,188,433 | 1/1940 | Friese | 269/71 X |
| 3,212,770 | 10/1965 | Stephens | 269/227 |
| 3,814,413 | 6/1974 | Bopp | 269/71 |
| 3,860,228 | 1/1975 | Cronier | 269/75 X |
| 3,977,662 | 8/1976 | Cook | 269/71 X |
| 4,095,778 | 6/1978 | Wing | 269/139 |

*Primary Examiner*—Robert C. Watson
*Attorney, Agent, or Firm*—Claude A. S. Hamrick

[57] ABSTRACT

An apparatus for supporting large, bulky work objects, particularly articles of furniture undergoing upholstery work, such that they may be tilted or rotated for easy access to any part of the work object by a stationary operator. The apparatus consists of a base which is firmly connected to the floor or work surface, a central support column rising out of the base, and a table which is firmly supported by the support column while being free to tilt approximately 45° from horizontal and to rotate 360° about its tilted position. The table member is expandable such that it may fit various sizes of work objects, and firmly hold the work object in place by outward pressure of the table against the inside surface of the work object. The operator may firmly maintain the table and work object in any desired tilt or rotation position by manual movement of the object to that position and foot-controlled brake mechanisms to hold the object in such position.

10 Claims, 5 Drawing Figures

ROTATABLE, TILTABLE AND EXPANDABLE UPHOLSTERY WORK TABLE

BACKGROUND OF THE INVENTION

1. Field of the Invention

This invention relates generally to work object support apparatuses and more particularly to work support tables, particularly as used in their upholstery trade, which are freely tiltable and rotatable.

2. Description of the Prior Art

It is often necessary for a workman to do fine, detailed work on a large and bulky item. This is particularly true in the furniture and reupholstery industries wherein it is frequently necessary to do fine work on a couch or large chair. Much of this upholstery work requires the operator to work on the object at strange angles, thus necessitating either the careful positioning of the object or working on the object at an uncomfortable angle for the craftsperson. Furthermore, since these objects are usually difficult to maneuver, it is necessary for the workman to move all around the work object to accomplish his purpose. This requires a particularly large area for the work to take place.

Ordinarily, upholstery and furniture detail work is accomplished by placing the item on the floor or other work surface or by placing it upon saw horses or other support means. The requirement that the workman have free access to all surfaces of the item necessitates a large work area. It also means that work necessary on the back or sides of the article either requires repositioning the article or causes the workman to have to proceed at uncomfortable and unwieldly angles or walk around the article, which can effect the quality of the workmanship.

Attempts have been made in the past to alleviate this problem by the expedient of securing the work object to a holding member or table which can be adjusted to various positions as desired by the operator. These prior art inventions help to alleviate the problem described by allowing some freedom of movement of the object rather than requiring operator to move.

One of the previous efforts in an attempt to solve these problems is found in Hanscom, U.S. Pat. No. 620,313. This patent describes a work holding stand or table which may be tilted to various degrees using a spring-loaded gear and pinion mechanism, and may be rotated to some degree using a direct turn and clamp mechanism. The Hanscom apparatus provides no means for securing the work object to the table or for easy operator control adjustment of the rotation and tilt of the table. In Hanscom the rotation cannot be adjusted while a work object is mounted on the table nor may a flat surface be placed against the table due to the location of the rotation lock.

A further example of the prior art in this field is contained in Dahms, U.S. Pat. No. 1,833,355. This patent describes a chair buck which is designed to attach to a chair and may be tilted at the operator's discretion. The chair buck described by Dahms may also be rotated on its axis to various discrete positions. In the case of both the rotation and the tilt, Dahms provides that only specific discrete positions may be obtained and held.

None of the prior art devices indicate any means by which an article of furniture or other large bulky work object may be firmly supported wherein it can be rotated or tilted to any desired position by the operator with a minimum of effort.

SUMMARY OF THE INVENTION

It is therefore an object of the present invention to provide an apparatus for securing and supporting large bulky work objects such as articles of furniture undergoing upholstery, while allowing the greatest possible access to each area of the work object to an operator remaining in one position.

It is also an object of this invention to provide a means by which a work object may be supported and may be independently rotated and tilted to any position relative the support means, and held in that position at the operator's discretion.

It is a further object of this invention to provide a means for supporting a large bulky work object which may be tilted to any angle, within certain bounds, that is desired by the operator and to maintain the object in that position.

Briefly, the present invention relates to a rotatable, tiltable and expandable work table for use with large bulky work objects such as articles of furniture. It is an apparatus comprised of a base which is firmly attached to the floor or work surface, a central support column firmly seated in such base and a table surface attached to the opposite ends of the column from said base. The table is attached to the column in such a manner that the table may be tilted approximately 45° from horizontal and may be rotated 360° relative the column. The table is held in position by various brake mechanisms which are operator controlled by way of foot pedals. The table is expandable such that it may fit any of various sizes of work objects and then may be locked in its expanded position by means of an expansion lock.

The means for attaching the table to the support column consists of a yoke which is placed upon the top of the support column, a pivot shaft affixed to the two arms of the yoke and a saddle which is rotatably connected to the pivot shaft and which rotatably fits into a molded depression in the bottom side of the table.

The rotation of the table is controlled by means of a standard automobile type drum brake mechanism located on the saddle. The saddle fits into a cylindrical molded depression in the underside of the table such that the brake shoes mounted on the saddle fit just inside the surface of the cylinder on the table. When the brake mechanism is not engaged when the operator applied pressure to the foot pedal, the brake shoes are retracted such that the table may rotate freely upon a central pivot post on the saddle, such rotation being lubricated by thrust and rotation bearings. In this mode the operator may manually turn the table and object to whatever position desired. However, when the rotation brake mechanism is activated, the brake shoes are forced outward and contact the inner surface of the cylinder of the bottom of the table. This friction holds the table and work object in whatever position it occupied at the time of the application of the brake.

When the apparatus is unattended, a spring mechanism holds the brakes in an activated position maintaining the table rotation stationary. However, the operator, by stepping upon the rotation brake foot pedal may release the brake and rotate the table and work object to whatever position he desires. Then, by the simple expedient of releasing the foot pedal, the work object and table are firmly secured in the desired position.

The tilt brake mechanism consists of a brake disk which is attached to the saddle and which extends vertically downward through a channel in the yoke and the top of the central support column. This disk is situated perpendicular to the pivot shaft upon which the saddle is mounted. Located in the inside of the support column is a disk brake mechanism which when engaged causes brake pads to contact the sides of the disk. Friction between the pads and the disk prevent motion of the disk. A spring mechanism maintains the brake pads in an engaged position when the apparatus is unattended, thus holding the table and work object at the desired tilt. When the operator wishes to alter the tilt of the table and work object, he releases the tilt brake by applying pressure to the tilt brake foot pedal. When the brake is released, he may manually adjust the tilt to whatever position he desires and then maintain that position by simply releasing the foot pedal.

An advantage of the present invention is that it provides an apparatus for supporting a large bulky work object such as an article of furniture undergoing reupholstery in such a manner that a single operator may obtain through access to all portions of the work object.

A further advantage of the present invention is that it supports a work object in such a manner that it may be rotated to any desired position while the object is mounted.

Another advantage of the present invention is that the operator may adjust the tilt of the table and work object to any desired position within approximately 45° of vertical while the object was mounted.

IN THE DRAWING

DETAILED DESCRIPTION OF THE PREFERRED EMBODIMENT

Figure 1:
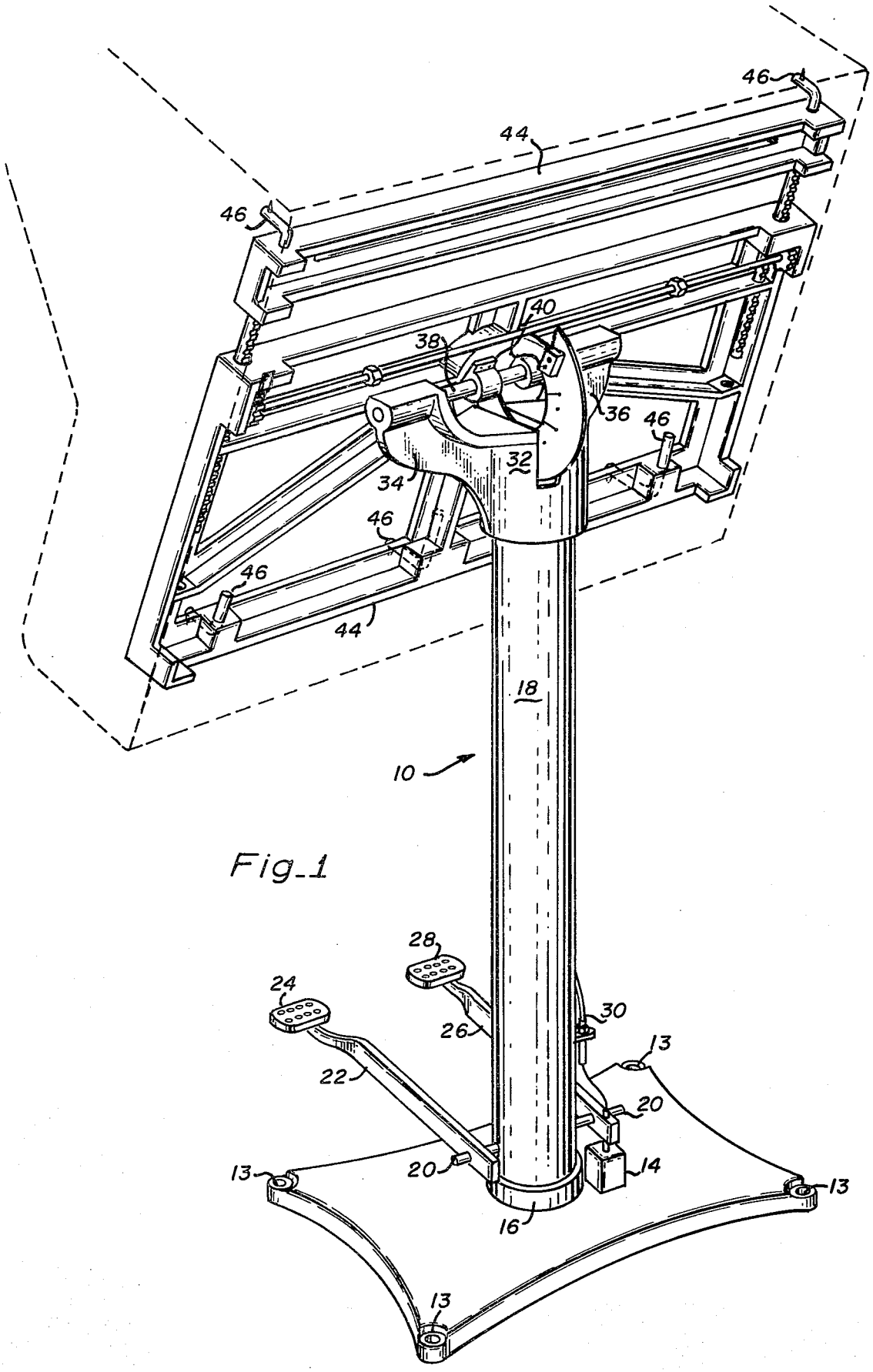
FIG. 1 is a perspective view of the present invention showing, in phantom, a work object, in this case a couch to be upholstered, mounted thereupon.

Referring now to FIG. 1, a perspective view of the present invention is shown. The invention, as illustrated, is a rotatable, tiltable and expandable upholstery work table 10 for use with large, bulky objects. The main use of table 10 relates to detail and upholstery work on large articles of furniture. Consequently, shown in phantom is a couch mounted upon the invention.

The invention is normally placed upon the floor or other solid, horizontal work surface. It is supported upon base 12 which is ordinarily secured to the floor of work surface by securing bolts or screws 13. Base 12 has horizontal dimensions of approximately 1 to 1½ feet and is approximately 1 inch thick. A portion of the base consists of a spring housing 14, which extends both slightly above the base and into the base.

Mounted upon the center section of base 12 is a column ring 16. This ring has an internal diameter of approximately 4¼ inches.

A cylindrical depression exists in base 12 directly under the opening in column ring 16. Mounted into the depression in base 12 and through column ring 16 is the central support column 18 of the invention. This column is approximately 3 inches in diameter, is hollow, and extends upward approximately 2 feet. The column is manufactured out of metal or some other strong material.

Passing through column 18 at a point just above column ring 16 and near the back of column 18 is shaft 20. Shaft 20 passes through an arc of the column which is approximately 2 inches in length and passes through a pair of apertures formed in the walls of the column such that the shaft 20 is vertically and horizontally supported by the column while remaining freely rotatable. Shaft 20 extends approximately 3 inches to either side of column 18. Intersecting shaft 20 a point to the left of column 18 is tilt brake lever 22. This lever is welded or otherwise firmly attached to shaft 20 such that when lever 22 is moved, shaft 20 rotates. Lever 22 is approximately 18 inches in length, extending to the back of the invention as shown and is composed of some rigid, strong material. Attached to the end of lever 22 at the point farthest from column 18 is foot pedal 24. Foot pedal 24 and lever 22 may be any of several commercially available varieties.

Mounted upon shaft 20 at a point to the right of column 18 is rotation brake lever 26. Lever 26 is similar in configuration to tilt brake lever 22, and also has foot pedal 28 attached to the end farthest from shaft 20. Rotation brake lever 26, however, is not firmly mounted upon shaft 20, but rather is freely mounted such that it may rotate on shaft 20 using it as a fulcrum.

Extending from the spring housing 14 located in the base by rotation brake lever 26 and extending to the upper portion of the invention is rotation brake cable housing 30.

Mounted on top of central support column is yoke 32. Yoke 32 is configured such that it fits snugly over the top of column 18 and may be firmly attached to the column. It has a squat, widened Y-shape having arms 34 and 36 extending upward and to the sides of the column 18. Connecting the upper portion of arms 34 and 36 is pivot shaft 38. This shaft is a solid cylinder constructed of a strong rigid material which is approximately 1 inch in diameter. It is rigidly mounted to arms 34 and 36 of yoke 32.

Attached to pivot shaft 38 at points such that it is centered approximately over the center of yoke 32 and column 18 is saddle 40. Saddle 40 is a metal member which is rotatably mounted on pivot shaft 38. Attached to the lower side of saddle 40 at its center and extending down through a vertical channel in column 18 is pivot brake disk 42.

Work table member 44 is mounted upon the top portion of saddle 40. Table member 44 is rectangular in configuration, having smallest horizontal dimensions of approximately 1½–2 feet, and being constructed of metal or other strong, rigid material. Table 44 has one adjustable horizontal dimension such that it may be varied in size to fit the dimensions of the desired work object. Mounted upon table 44 at various points, three to the front and two to the back, are work securing posts 46.

Figure 2:
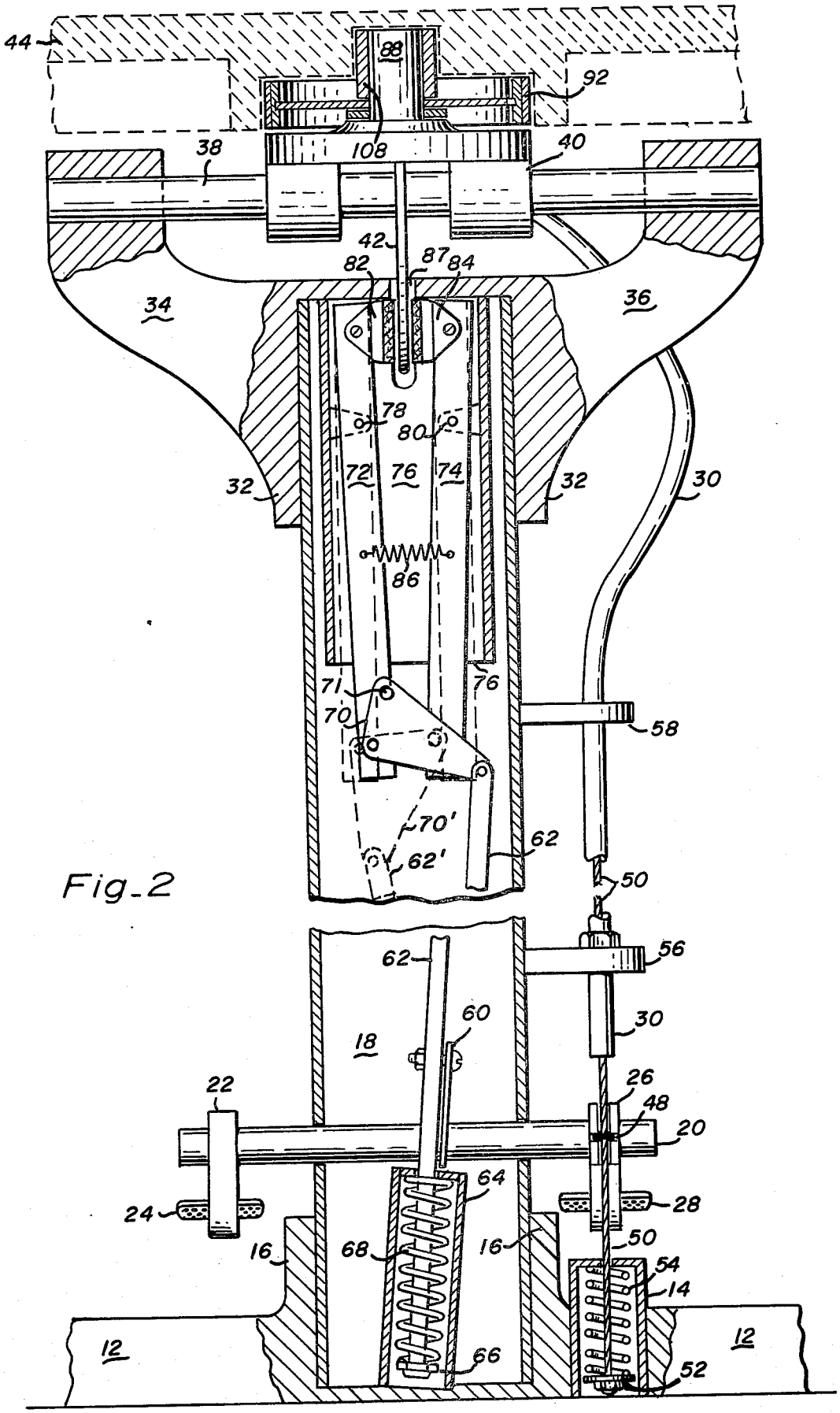
FIG. 2 is a partially broken front elevational view of the lower portions of the present invention illustrating the operation of the tilt brake mechanism in the lower portions of the rotation brake mechanism.

Referring now to FIG. 2, a partially broken front elevational view of the lower portion of the invention illustrates the mechanism situated within the interior of column 18 and base 12, and particularly illustrates the lower portion of the rotation brake mechanism and the entire tilt brake mechanism.

Describing the rotation brake mechanism, rotation brake lever 26, to which is attached foot pedal 28, is rotatably affixed to shaft 20. Shaft 20 acts as a fulcrum such that when downward pressure is placed upon pedal 28 the end of lever 26 opposite pedal 28 moves upward.

The near end of lever 26, that is the end opposite pedal 28, is indented in a cross-like configuration. Both a horizontal and a vertical groove exist in the end of lever 26. This configuration allows stud 48 on rotation brake cable 50 to fit securely into the horizontal groove in the end of lever 26 while cable 50 extends through the vertical groove. This arrangement maintains a secure connection between lever 26 and cable 50 while allowing easy disconnection when it is desired. Cable 50 continues down below lever 26 to enter spring housing 14, located in base 12. At about the bottom of spring housing 14 cable 50 ends and is firmly connected to plate 52. Situated between plate 52 and the top of spring housing 14 is strong compression spring 54.

Cable 50 extends upward through housing 30 and through housing brackets 56 and 58 which are firmly mounted on central support column 18.

When no pressure is being applied to foot pedal 28, strong compression spring 54 applies downward force upon plate 52. This downward force is sufficient to keep cable 50 at its lowest position. This pull on cable 50 results in a downward force on the near end of lever 26, and consequently an upward force on pedal 28. The force of spring 54 can be overcome and the brake cable may be pushed upwardly by stepping on foot pedal 28. This causes the grooved end of lever 26 to move upwardly, elevating stud 48 which pulls cable 50 upward, thus deactivating the rotation brake mechanism.

The tilt brake mechanism is located entirely within column 18. This mechanism controls the amount by which table 44, not shown, and the work object mounted upon it, can be tilted from the vertical to allow easy access to various portions of the work object.

The operator control means within the tilt brake mechanism are tilt brake lever 22 and foot pedal 24. Lever 22 is firmly attached to shaft 20 such that when pressure is applied to foot pedal 24 shaft 20 rotates.

Attached to shaft 20 at a point inside column 18 is connecting rod 60. Connecting rod 60 is situated on shaft 20 in such a manner that downward pressure on foot pedal 24 causes shaft 20 to rotate and connecting rod 60 to exert an upward force onto brake rod 62 to which the opposite end of connecting rod 60 is attached.

Brake rod 62 extends downward below shaft 20 into pivoting spring housing 64. Spring housing 64 is attached to base 12 in such a manner that it may pivot slightly in the vertical direction. Near the bottom of housing 64 brake rod 62 ends in a firm connection with plate 66. Situated between plate 66 and the upper surface of spring housing 64 is a strong compression spring 68.

Extending above shaft 20 brake rod 62 continues to a point near the top of column 18 wherein it intersects cam 70. Cam 70 is generally shaped like a rounded right triangle with the connection to brake rod 62 being at the acute base angle. At the other acute angle is located a contact post 71 which extends back away from the viewer. The right angle corner of cam 70 is pivotally attached to left brake arm 72.

Opposite left brake arm 72 is right brake arm 74. The brake arms extend upward towards the top of column 18 and enter brake box 76. Brake box 76 is a smaller dimensions than of column 18 and is firmly attached to the inside of column 18. Located on the inside of brake box 76 are pivot points 78 and 80 upon which left brake arm 72 and, respectively, right brake arm 74 pivot. Brake pads 82 and 84 are pivotally connected to the upper ends of left and right brake arms 72 and 74. A weak tension spring 86 connects brake arms 72 and 74 at points below pivot point 78 and 80.

The tilt brake mechanism operates as follows. When pressure is applied to foot pedal 24, as shown, lever 22 causes shaft 20 to rotate. This rotation causes connecting rod 60 to exert an upward force on brake rod 62. Brake rod 62 then forces cam 70 upward such that contact post 71 is pushed back to contact left brake arm 72. Tension spring 86 then acts to pull the lower ends of brake arms 72 and 74 together. Since the brake arms are pivoted on points 78 and 80, their upper ends are thus pulled apart and brake pads 82 and 84 are pulled apart so that they do not contact brake disk 42 which extends between them. When no braking pressure is being applied on tilt brake disk 42 by pads 82 and 84, the disk, the saddle 40 to which it is connected, and the table which is attached to the saddle are free to tilt upon the axis of rotation of pivot shaft 38.

When no pressure is applied to foot pedal 24, strong compression spring 68 controls. This spring exerts a strong downward force on plate 66 and causes brake rod 62 to be held in its lowest possible position. This causes rod 62 to pull downward on the corner of cam 70, as shown in the phantom. When the acute base angle of cam 70 is pulled downward, the cam pivots upon its right angle connection with left brake arm 72 and causes contact post 71 to rotate and contact right brake arm 74. This contact forces the bottom end of brake arms 72 and 74 apart. Since the arms are pivoted on points 78 and 80, the upper portions are forced together causing brake pads 82 and 84 to firmly contact disk 42. In this position, a strong frictional force is placed on disk 42 so that it cannot rotate and the disk, the saddle and the table are firmly held in position.

FIG. 2 also illustrates the manner in which yoke 32 fits over the top of column 18. It can be seen that a vertical channel 87 is cut into both the yoke and the column such that tilt brake disk 42 may extend downward into the column to come in contact with the tilt brake mechanism.

The manner in which pivot shaft 38 intersects arms 34 and 36 of yoke 32 is also shown, as well as the manner in which saddle 40 is connected to pivot shaft 38.

Figure 3:
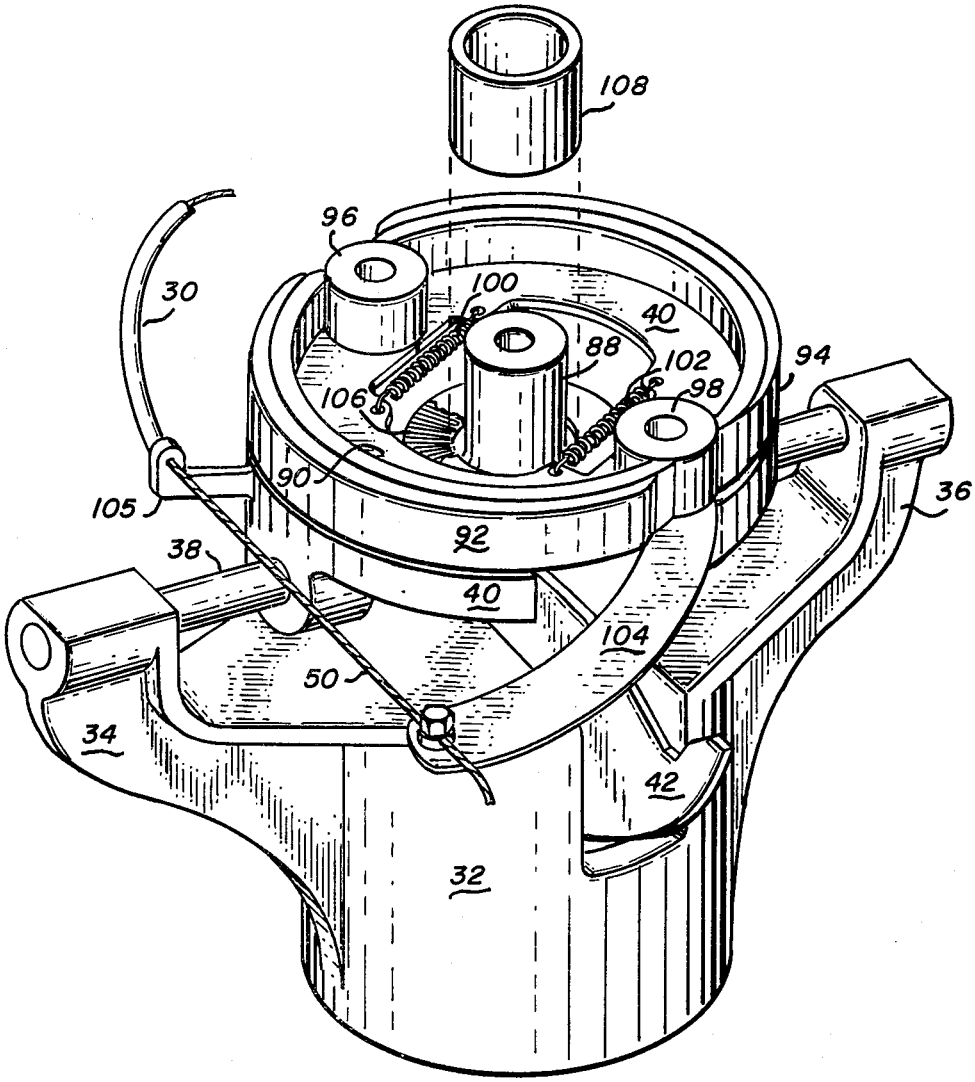
FIG. 3 is a perspective view of the top of the column, yoke and saddle elements illustrating the upper portion of the rotation brake mechanism.

In FIG. 3 a perspective view of the yoke and saddle members particularly illustrating the upper portion of the rotation brake mechanism is shown. This figure also illustrates the manner in which tilt brake disk 42 is mounted upon saddle 40.

Part of the upper portion of saddle 40 is a central pivot post 88. The remaining portion of the upper surface of saddle 40 is a horizontal circular contact surface 90. Mounted upon saddle 40 is the rotation brake mechanism.

The rotation brake mechanism is an ordinary automobile type drum brake mechanism. It consists of two brake shoes 92 and 94, which are semicircular in shape and have brake shoe contact material, or soles, on their outer surface. These brake shoes are arranged horizontally upon saddle 40. At one end, brake shoes 92 and 94 are connected by connecting post 96. The opposite ends of shoes 92 and 94 are separated by a cam 98. Shoes 92 and 94 are held in as close proximity as possible by tension spring 100 and 102. Connected to cam 98 is brake control lever 104. This lever extends to the side of saddle 40 and its far end is attached to rotation brake cable 50. This cable passes through a support bracket 105 and extends into housing 30 and so on down to the base of the invention.

A cylindrical shaped depression on the bottom of table 44, not shown, fits over the brake shoes 92 and 94 when the invention is assembled. In this assembly there is only a small margin of space between brake shoes 92 and 94 and the interior surface of the cylindrical depression in the bottom of table 44.

The rotation brake mechanism operates as follows. When rotation brake cable 50 is pulled towards the bottom of the invention by spring 68, illustrated in FIG. 2, the end of brake control arm 104 is pulled toward support bracket 105. This causes cam 98 to exert an outward force upon the ends of brake shoes 92 and 94, forcing them apart. Brake shoes 92 and 94 in turn place a force against the interior of the cylindrical depression in the table thus effectively stopping any rotation.

When cam 98 is not activated by cable 50 pulling upon brake arm 104, springs 100 and 102 draw brake shoes 92 and 94 together thus causing no outward force upon the interior of the cylindrical depression in the table and thus allowing free rotation of the table upon the saddle.

Also illustrated in FIG. 3 are the means by which the table is supported and rotated on saddle 40. The second cylindrical depression in the table fits over pivot post 88 and rests upon contact surface 90. A thrust bearing 106 fits between this cylinder and contact surface 90 and a rotation bearing 108 fits between the table cylinder and contact post 88. These bearings allow the table to freely rotate with a minimum of friction upon saddle 40.

Tilt brake disk 40 is shown to be mounted upon saddle 40 by being firmly connected, at the ends of the semicircular disk, to appendages of the saddle.

Figure 4:
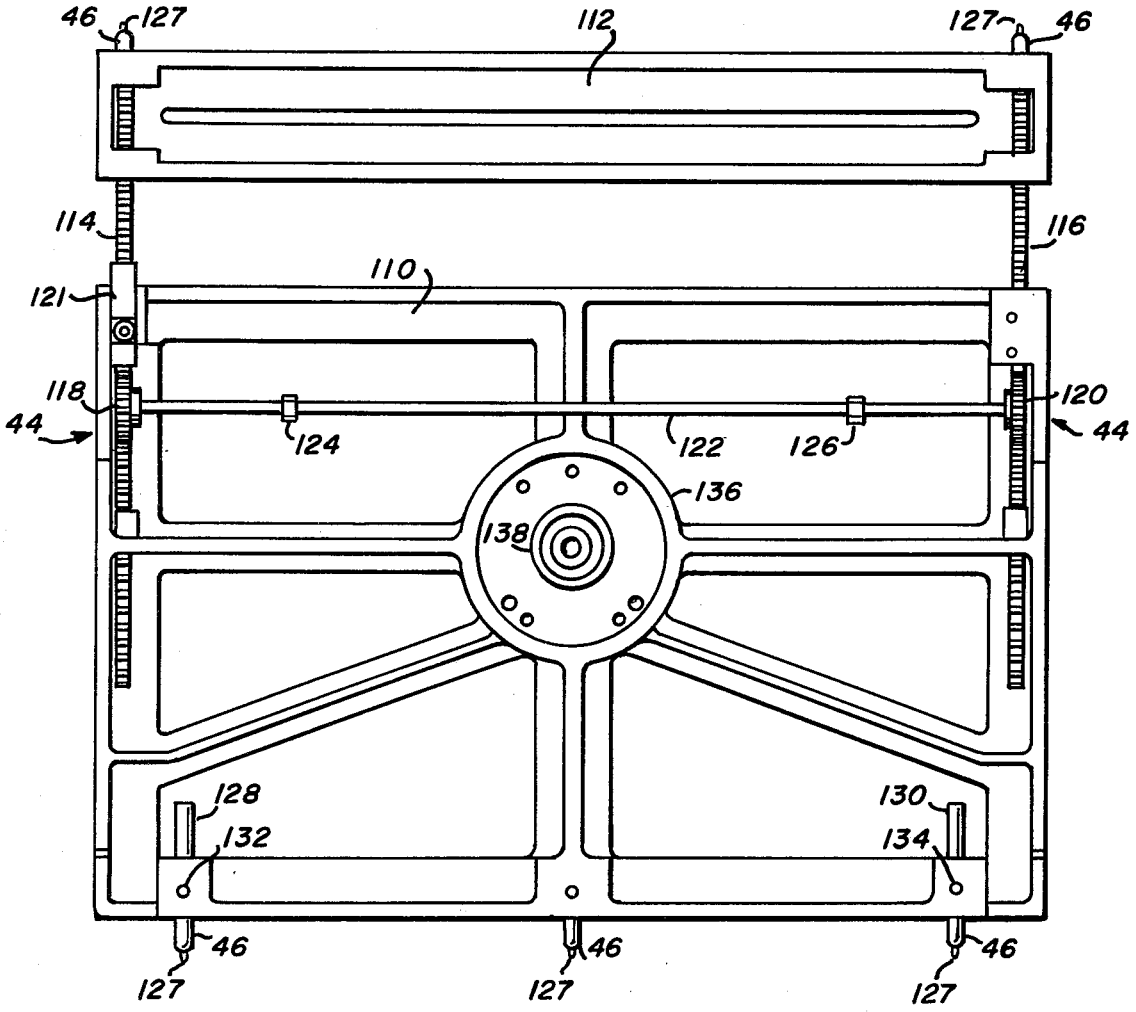
FIG. 4 is a bottom plan view of the table element.
Figure 5:
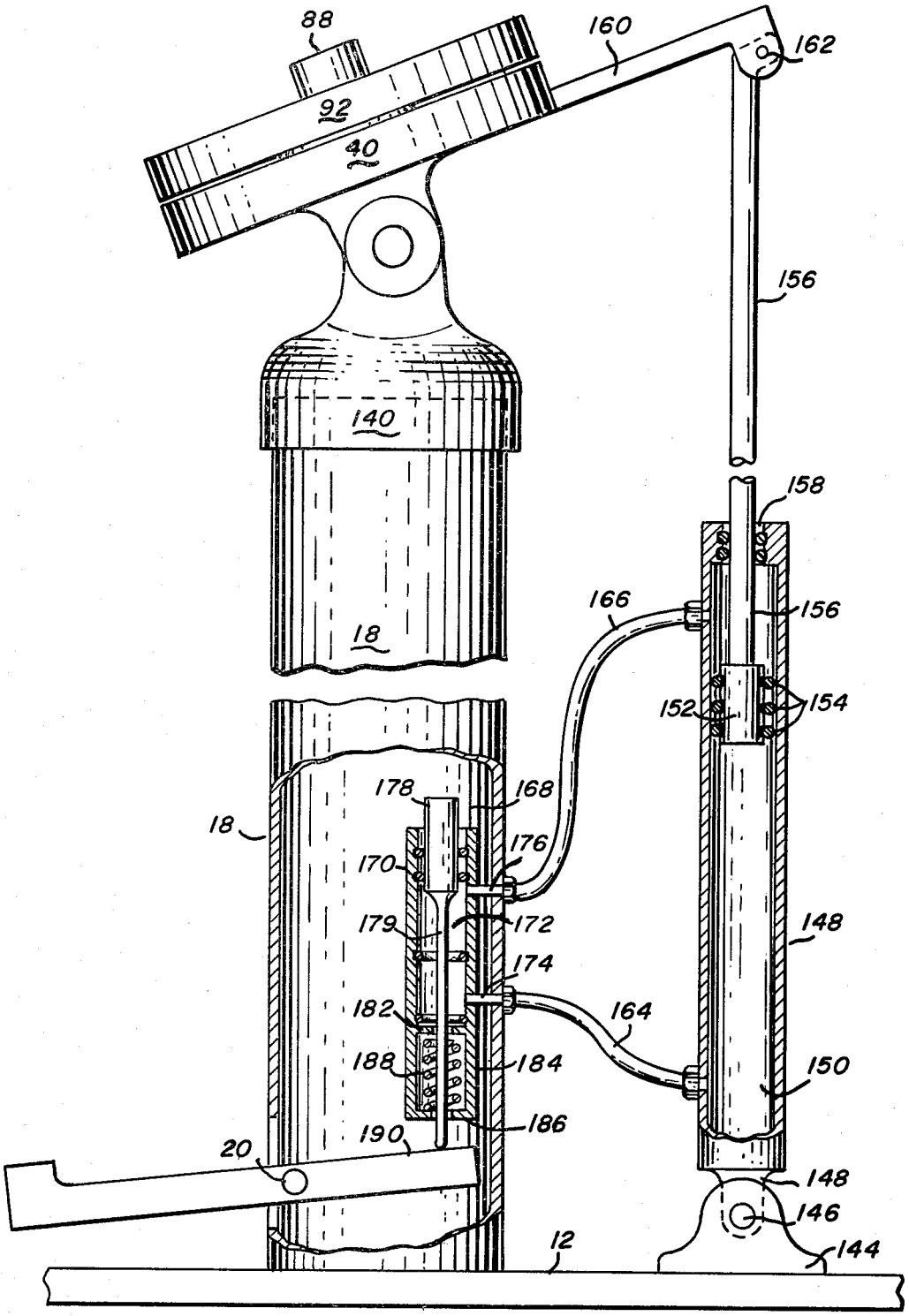
FIG. 5 is a left side elevational view of the lower portion of an alternate embodiment of the present invention illustrating a hydraulic tilt brake mechanism.

In FIG. 4, a bottom plan view of the table element 44 is shown. This figure illustrates the means by which the table is mounted upon saddle 40 and the means by which the configuration of the table may be altered to fit the desired size of work object.

As illustrated, table element 44 consists of two segments, a main portion 110 and an extension 112. The two sections of the table are connected in such a manner that their separation may be adjusted by the operator. The adjustment and separation is useful for fitting the table to the external dimensions of a work object.

Extension 112 is connected to main section 110 by channeled shafts 114 and 116. These shafts are firmly connected to extension 112 and fit into apertures in the main section such that the shafts may extend varying distances into the main section. Shafts 114 and 116 contact adjusting wheels 118 and 120 in the main section. The adjusting wheels are configured such that their exteriors are geared to fit into channels in the surface of shafts 114 and 116 such that when wheels 118 and 120 are turned, a corresponding horizontal motion in shafts 114 and 116 results. This configuration is a standard rack and pinion mechanism.

A spring loaded pawl 121 engages the teeth of one of the adjusting wheels. The pawl acts as a locking mechanism which must be disabled prior to the attempted rotation of the adjusting wheels.

Adjusting wheels 118 and 120 are connected by adjusting shaft 122 which extends across the main section of the table. At points along adjusting shaft 122 are adjusting nuts 124 and 126. These nuts are firmly attached to shaft 122 and are configured such that they may be gripped by a wrench or other grasping tool.

When the operator wishes to adjust the configuration of table 44, he disables the pawl locking mechanism and then he may turn adjusting shaft 122 either by hand or by attaching a wrench to adjusting nut 124 or adjusting nut 126. This causes adjusting wheels 118 and 120 to turn. The turning of wheels 118 and 120 causes horizontal motion is shafts 114 and 116 due to the interlocking gearing of the channels in shafts 114 and 116 and the teeth extending from wheels 118 and 120. This horizontal motion in the shafts 114 and 116 results in extension 112 being pushed farther from main section 110 or pulled closer to main section 110 depending on the direction of turning of shaft 122. The pawl is then released to lock the extension in position. Attached to the ends of shafts 114 and 116, which are bonded to extension 112, are work securing posts 46. These posts have spikes 127 which extend outward into the interior surface of the work object. Three more work securing posts 46 are located on the main section, on the side opposite the extension. These posts also have spikes 127 extending to the exterior.

The distance between the surface of the main section 110 and the outside pair of these posts 46 may be adjusted by means of rods 128 and 130 and set screws 132 and 134. Rods 128 and 130 extend slideably through an aperture in the surface of main section 110. Rods 128 and 130 may be placed in whatever position desired and secured there by means of set screws 132 and 134. In this manner also the operator may adjust the configuration of the holding means on the table to fit the configuration of the work object.

The central portion of the underside of main section 110 contains the molded segments which fit onto saddle 40. A molded ring segment 136 of depth approximately 1½ inch is designed to fit reasonably snuggly over brake shoes 92 and 94, illustrated in FIG. 3. The interior surface or ring 136 is the drum upon which brake shoes 92 and 94 apply pressure, arresting the rotational motion of table member 44.

Interior molded cylinder 138, also a depth approximately 1½ inch, provides a means upon which the table member 44 is supported and rotated on saddle 40. Cylinder 138 fits over post 88, shown in FIG. 3, and sets upon contact surface 90 of saddle 40. The contact between cylinder 138 and saddle 40 is buffered by thrust bearing 106 and rotation bearing 108 shown in FIG. 3 which provide for easy rotation of the table member 44 upon the saddle 40.

Referring now to FIG. 4, a left side elevational view of an alternate embodiment of the present invention cut away to show an alternate yoke and tilt control system.

In the alternate embodiment, alternate yoke 140 rests upon central column 18 in a manner similar to that of yoke 32 in the preferred embodiment. In this embodiment, however, there is no need for a vertical channel such as that shown in FIG. 2. In this alternate embodiment the yoke and shaft are substantially the same as those members of the preferred embodiment.

The alternate tilt brake and control mechanism is a hydraulic system. This system can be connected to a point on the outside portion of the saddle and can provide easily controlled positioning of the tilt of the work object.

The exterior portion of the hydraulic system is set upon a pivoting base 144 which is disposed on the base 12 proximate the column hub. This pivoting base 144 is connected by a pivot post 146 to hydraulic cylinder 148.

Hydraulic cylinder 148 is a vertical tubular member which is filled with hydraulic fluid 150. Slideably encased in cylinder 148 is piston 152 which is surrounded by piston rings 154. These rings maintain a tight seal between piston 152 and the walls of cylinder 148. Connected to piston 152 is piston rod 156 which extends through a tight seal 158 at the top of cylinder 148 and continues up to the height of saddle 40 where it connects to an arm 160, extending from saddle 40, at pivot point 162.

Extending from the side of cylinder 148 at a point near the bottom of the cylinder is a flexible tube 164. Another flexible tube 166 extends from the side of cylinder 148 at a point near the top of the cylinder. The cylinder is of sufficient height such that the openings for tubes 164 and 166 separated sufficiently that a change in the vertical position of pivot point 162 of the magnitude of the distance of separation produces a sufficient range of tilt to satisfy the needs of the operator. Tubes 164 and 166 carry hydraulic fluid 150 from the cylinder to belt mechanism 168 which is located inside central support column 18.

Valve mechanism 168 consists of a housing 170, a valve cylinder 172 with exit ports 174 and 176 connecting to tube 164 and 166, respectively. Situated inside a valve cylinder 172 and extending beyond the ends of valve cylinder 172 are valve piston 178 and valve piston rod 179. Piston 178 is of nearly the same diameter as the interior of valve cylinder 172 such that it fits snugly within the cylinder while rod 179 is of a significantly smaller diameter. Piston 178 extends above valve cylinder 172 through fluid tight seal 180, while rod 179 extends below valve cylinder 172 through fluid tight seal 182.

Beneath valve cylinder 172 is a spring housing chamber 184. Rod 179 extends through housing 184 and out of the bottom of the housing. Within housing 184 and near the bottom of same, plate 186 is firmly attached to rod 179. Situated between plate 186 and the top surface of housing 184 is compression spring 188 through which rod 179 passes. Beneath the spring housing 184 rod 179 contacts alternate tilt brake lever 190. In this alternate embodiment, lever 190 is not firmly attached to shaft 20, as is lever 22 in the preferred embodiment, but is only pivoted upon shaft 20 such that shaft 20 acts as a fulcrum.

The alternate tilt brake mechanism operates as follows. When no pressure is applied to foot pedal 24, not shown, compression spring 188 forces down upon plate 186 and consequently pivot rod 179, causing piston 178 to move down into valve cylinder 172 and close off exit port 176. With exit port 176 closed, there is no channel by which hydraulic fluid 150 can circulate from the upper portion of hydraulic cylinder 148, that is above piston 152, to the lower portion of hydraulic cylinder 148, that is the portion below piston 152. Since hydraulic fluid 150 is noncompressable and piston rings 154 prevent the flow of hydraulic fluid around piston 152, the piston is held firmly in position by hydraulic pressure. This means that saddle 40 and table 44 are held in whatever position they occupied at the time that exit port 176 was closed.

When downward pressure is applied on foot pedal 24 however, lever 190 applies upward pressure on valve piston rod 179 causing piston 178 to move upward in valve cylinder 172, opening port 176. At this point a flow channel exists through flexible tubes 164 and 166 and valve cylinder 172 between the upper and lower portion of hydraulic cylinder 148. While this channel is open manual movement of the table or work object will cause piston 152 to slide up or down within cylinder 148, displacing hydraulic fluid through the channel to the opposite side of piston 152. In this manner the operator may adjust the tilt of the work object to whatever position he wishes and then by removing the pressure from foot pedal 24, firmly maintaining the work object and table in such position.

The hydraulic cylinder is pivotally mounted upon base 144 to allow for the horizontal displacement of pivot point 162 caused by rotation about a fixed axis.

All of the component parts of the present invention are commercially available or easily built.

Although the present invention has been described above in terms of the presently preferred embodiments, it is to be understood that such disclosure is not to be considered to be as limiting. Accordingly, it is intended that the appended claims are to be interpreted as covering all alterations and modifications as fall within the true spirit and scope of the invention.

What is claimed is:

1. A stationary support apparatus for large, bulky work objects comprising:

a base;

means for firmly affixing said base to a stationary surface;

a central support column firmly affixed to said base;

a support table situated at the opposite end of said column from said base;

means for affixing said table to said column and providing for free rotational motion of said table upon said column and nondiscrete vertical tilt motion of said table upon said column to the extent of a predetermined range of angles from horizontal, and including a yoke which fits over the top of the column and is firmly affixed thereto, said yoke having arms extending upward on two sides;

a horizontal pivot shaft connecting the arms of said yoke and being nonrotatably mounted to said arms;

a saddle rotatably attached to said pivot shaft and centered over the center of said yoke and said support column;

a semicircular plate connected at its ends to said saddle such that it depends perpendicularly to said pivot shaft and having a center segment removed such that it fits around said pivot shaft;

a pivot post extending vertically from the center of the upper surface of said saddle;

a thrust bearing surrounding said post; and a molded portion of the lower surface of said table such that said table is supported upon said thrust bearing and rotates about said pivot post;

operator-controlled means for normally arresting the rotational movement of said table and firmly holding said table in any desired rotational position;

operator-controlled means for normally arresting the vertical tilt motion of said table at any desired angle within said predetermined range and holding said table in such position;

operator-controlled means for altering the dimensions of said table to provide for firm attachment of said work object to said table; and means for grasping said work object and firmly attaching it to said table.

2. A stationary support apparatus for large bulky work objects as recited in claim 1 wherein said operator-controlled means for arresting the rotational movement of said table and firmly holding said table in any desired rotational position includes:

a shaft placed through a rear horizontal arc in the lower portion of said central support column and extending a short distance to each side;

a rotation brake lever slidably attached to said shaft at a point to one side of said column such that said shaft provides a fulcrum for said lever and having one end configured with an indented cross shape such that perpendicularly bisecting channels exist on the end surface of said lever and foot pedal attached to the opposite end;

a cable;

a housing mounted upon said base into which one end of said cable extends vertically and wherein the end of said cable connects to a flat plate;

a strong compression spring situated within said housing, vertically encasing a segment of said cable and separating said plate from the upper surface of said housing;

a stud firmly swagged to said cable at a point such that said stud fits into one of the perpendicularly bisecting channels in the end of said rotation brake lever while the cable fits into the other channel;

a brake control lever attached at one end to the other end of said cable from said flat plate and mounted, at said levers other end, upon a brake cam attached to said saddle;

a brake control cylinder with expander posts which move into or out of the sides of the cylinder as controlled by the brake control lever;

a pair of brake shoes pivotally attached to each other at one end and contacting said expander posts at the other end which are mounted upon the upper surface of said saddle so as to form a horizontal ring;

a pair of tension springs connecting said brake shoes such that said shoes are drawn together to the extent allowed by the position of said expander posts; and a cylinder depression on the underside of said table member which fits over the ring formed by said brake shoes such that when said expander posts are extended the brake shoes are forced apart such that their outer surfaces, or soles, make firm contact with the inner surface of said cylindrical depression.

3. A stationary support apparatus for large bulky work objects as recited in claim 1 wherein said operator-controlled means for arresting the vertical tilt motion of said table at any desired angle within said predetermined range and holding said table in such position includes:

a shaft placed through a rear horizontal arc in the lower portion of said central support column, being free to rotate therein, and extending a short distance to each side;

a tilt brake lever perpendicular to said shaft and firmly attached to said shaft at a point on one side of the column having a foot pedal attached to the end of said tilt brake lever farthest from said shaft such that downward pressure on said foot pedal causes the shaft to rotate;

a connecting rod firmly attached at one end to a point upon said shaft in the interior of the column such that when said shaft rotates the other end of said connecting rod moves up or down according to the direction of shaft rotation;

a brake rod vertically situated in the interior of the column and having said connecting rod pivotally attached to an interior point, an end extending downward into the base and attaching to a circular flat plate, and an end extending upward into the column;

a housing pivotally attached at its bottom to said base having an aperture at its top such that said brake rod extends downward into it and containing, at the end of said brake rod, said flat plate which is of only slightly smaller diameter than the interior of said housing;

a compression spring contained in said housing such that it vertically surrounds the segment of said brake rod contained in the housing and is compressed between said flat plate and the top interior surface of the housing;

a triangularly-shaped cam pivotally attached at a lower apex to the upper end of said brake rod;

a left brake arm to which, at the lower end of the arm, the other lower apex of said cam is pivotally attached, such arm being a lever extending upward into the top portion of said column;

a right brake arm being essentially a mirror image of said left brake arm except that no pivotal cam connection exists on said right brake arm;

a contact post protruding from the upper apex of said cam such that when said brake rod pulls downward on the cam the cam pivots so that contact post engages the lower portion of said right brake arm and forces the lower ends of said brake arms apart;

a brake housing situated in the interior of the upper portion of said central support column and into which the upper portions said left and right brake arms extend;

first and second pivot points extending inward from horizontally opposing points on the interior of said brake housing to intersect the left and right brake arms, respectively;

a left brake pad pivotally attached to the upper end of said left brake arm and extending towards the center of said column;

a right brake pad, substantially similar to said left brake pad, pivotally attached to the upper end of said right brake arm and extending towards the center of said column;

a U-shaped slot in the top of said yoke, said column and said housing, said slot extending perpendicular to the axis of said pivot shaft;

said semicircular plate attached to said saddle such that it extends vertically downward into said slot and into the space separating said left and right brake pads and such that when said brake pads are forced together by the bottom end of the brake arms being forced apart said semicircular plate is engaged by said pads and frictionally held in position by such engagement; and a tension spring connecting the lower portions of said left and right brake arms such that when not forced apart by the cam and contact post the lower portions of said brake arms are held together by said tension spring.

4. A stationary support apparatus for large bulky work objects as recited in claim 1 wherein said operator-controlled means for altering the dimensions of said table to provide for firm attachment of said work object to said table includes:

a main table section being generally rectangular in shape;

a rectangular extension section of the table being the same width as the width of the main section and being a substantially narrower rectangle;

rack-and-pinion means for connecting the main and extension sections of said table in the same plane and for adjusting the separation distance between said sections; and operator adjustable means for operating said rack-and-pinion means even while a work object obscures the upper surface of the table sections; and means for locking said rack-and-pinion means in an adjusted position.

5. A stationary support apparatus for large bulky work objects as recited in claim 1, said means for grasping said work object and firmly affixing it to said table comprises:

work-holding posts situated along the vertical surfaces of said table sections which are perpendicular to the direction of adjustable separation of the table means, such posts having spikes extending outward for embedding into and firmly holding work objects as said table is expanded to the dimensions of the work object.

6. A stationary support apparatus for large bulky work objects as recited in claim 2 wherein said operator controlled means for arresting the vertical tilt motion of said table at any desired angle within said predetermined range and holding said table in such position includes:

a shaft placed through a rear horizontal arc in the lower portion of said central support column, being free to rotate therein, and extending a short distance to each said, said shaft being the same shaft to which is attached, at the other end of said shaft, said rotation brake lever;

a tilt brake lever perpendicular to said shaft and firmly attached to said shaft at a point on one side of the column having a foot pedal attached to the end of said tilt brake lever farthest from said shaft such that downward pressure on said foot pedal causes the shaft to rotate;

a connecting rod firmly attached at one end to a point upon said shaft in the interior of the column such that when said shaft rotates the other end of said connecting rod moves up or down according to the direction of shaft rotation;

a brake rod vertically situated in the interior of the column and having said connecting rod pivotally attached to an interior point;

an end extending downward into the base and attaching to a circular flat plate, and an end extending upward into the column;

a housing pivotally attached at its bottom to said base having an aperture at its top such that said brake rod extends downward into it and containing, at the end of said brake rod, said flat plate which is of only slightly smaller diameter than the interior of said housing;

a strong compression spring contained in said housing such that it vertically surrounds the segment of said brake rod contained in the housing and is compressed between said flat plate and the top interior surface of the housing;

a triangularly-shaped cam pivotally attached at a lower apex to the upper end of said brake rod;

a left brake arm to which, at the lower end of the arm, the other lower apex of said cam is pivotally attached, such arm being a lever extending upward into the top portion of said column;

a right brake arm being essentially a mirror image of said left brake arm except that no pivotal cam connection exists on said right brake arm;

a contact post protruding from the upper apex of said cam such that when said brake rod pulls downward on the cam the cam pivots so said contact post engages the lower portion of said right brake arm and forces the lower ends of said brake arms apart;

a brake housing situated in the interior of the upper portion of said central support column and into which the upper portions said left and right brake arms extend;

first and second pivot points extending inward from horizontally opposing points on the interior of said brake housing to intersect the left and right brake arms, respectively;

a left brake pad pivotally attached to the upper end of said left brake arm and extending towards the center of said column;

a right brake pad, substantially similar to said left brake pad, pivotally attached to the upper end of said right brake arm and extending towards the center of said column;

a U-shaped slot in the top of said yoke, said column and said housing, said slot extending perpendicular to the axis of said pivot shaft;

said semicircular plate attached to said saddle such that it extends vertically downward into said slot and into the space separating said left and right brake pads and such that when said brake pads are forced together by the bottom end of the brake arms being forced apart said semicircular plate is engaged by said pads and frictionally held in position by such engagement; and a tension spring connecting the lower portions of said left and right brake arms such that when not forced apart by the cam and contact post the lower portions of said brake arms are held together by said tension spring.

7. A stationary support apparatus for large bulky work objects as recited in claim 6 wherein said operator controlled means for altering the dimensions of said table to provide for firm attachment of said work object to said table includes:

a main table section being generally rectangular in shape;

a rectangular extension section of the table being the same width as the width of the main section and being a substantially narrower rectangle;

rack-and-pinion means for connecting the main and extension sections of said table in the same plane and for adjusting the separation distance between said sections; and operator adjustable means for operating said rack-and-pinion means even while a work object obscures the upper surface of the table sections.

8. A stationary support apparatus for large bulky work objects as recited in claim 7 wherein said means for grasping said work object and firmly affixing it to said table comprises:

work-holding posts situated along the vertical surfaces of said table sections which are perpendicular to the axis of expansion and retraction of the table means, such posts having spikes extending outward for embedding into and firmly holding work objects as said table is expanded to the dimensions of the work object.

9. A stationary support apparatus for large bulky work objects as recited in claim 1 wherein said means for affixing said table to said column includes:

a yoke which fits over the top of the column and is firmly affixed thereto;

a saddle secured by some pivotal means to said yoke, said saddle being free to pivot about a horizontal axis about which the pivot means is symmetrical, said saddle being centered over the center of said yoke and said support column;

a semicircular plate connected at its ends to said saddle such that it is perpendicular to said pivot shaft and having a center segment removed such that it fits around said pivot shaft;

a pivot post extending vertically from the center or the upper surface of said saddle;

a thrust bearing surrounding the bottom of said pivot post;

a rotary bearing surrounding said post;

a molded portion of the lower surface of said table such that said table is supported upon said thrust bearing and rotates about said pivot post.

10. A stationary support apparatus for large bulky work objects as recited in claim 9 wherein said operator-controlled means for arresting the vertical tilt movement of said table at any desired angle within a predetermined range includes:

a movable base element for placing on the floor or work surface;

a substantially vertical hydraulic cylinder pivotally attached to said base, said cylinder being filled with noncompressable hydraulic fluid and having fluid ports at two points, one proximate to the top of the cylinder and one proximate to the bottom of the cylinder;

a piston contained within said cylinder being surrounded by piston rings which prevent flow of fluid between the piston and the cylinder walls;

a piston rod extending from the top of said piston through a fluid-tight seal at the top of the cylinder and continuing vertically upward towards the table;

a saddle arm being a rigid rod extending perpendicular to the axis of rotation of said saddle and horizontally from a point on the side of said saddle to the top of said piston rod, to which it is pivotally connected, the length of the saddle arm being such that a vertical change in the position of point where it is pivotally connected to said piston rod of the distance between said top and bottom fluid ports on the hydraulic cylinder produces a range of tilts in the table and work object of the extent desired;

valve means for opening and closing a channel between the top and bottom fluid ports, thus allowing or arresting motion of said piston in said cylinder; and operator-controlled means for opening and closing said valve means to allow the adjustment of the vertical tilt of said table and work object.

* * * * *